US007786829B2

(12) United States Patent
Prechtel et al.

(10) Patent No.: US 7,786,829 B2
(45) Date of Patent: Aug. 31, 2010

(54) HIGH FREQUENCY MEMS SWITCH HAVING A BENT SWITCHING ELEMENT AND METHOD FOR ITS PRODUCTION

(75) Inventors: Ulrich Prechtel, Munich (DE); Volker Ziegler, Neubiberg (DE)

(73) Assignee: EADS Deutschland GmbH, Ottobrunn (DE)

( * ) Notice: Subject to any disclaimer, the term of this patent is extended or adjusted under 35 U.S.C. 154(b) by 440 days.

(21) Appl. No.: 10/590,699

(22) PCT Filed: Feb. 25, 2005

(86) PCT No.: PCT/DE2005/000317

§ 371 (c)(1),
(2), (4) Date: May 23, 2007

(87) PCT Pub. No.: WO2005/083734

PCT Pub. Date: Sep. 9, 2005

(65) Prior Publication Data

US 2007/0215446 A1 Sep. 20, 2007

(30) Foreign Application Priority Data

Feb. 27, 2004 (DE) ..... 10 2004 010 150

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,373,682 B1 4/2002 Goodwin-Johansson 6,456,420 B1 * 9/2002 Goodwin-Johansson .... 359/291

(Continued)

FOREIGN PATENT DOCUMENTS

EP 1 026 718 A2 8/2000

(Continued)

OTHER PUBLICATIONS

International Search Report dated Jun. 29, 2005 with an English translation of the pertinent portion (Thirteen (13) pages).

(Continued)

*Primary Examiner*—Elvin G Enad
*Assistant Examiner*—Bernard Rojas
(74) *Attorney, Agent, or Firm*—Crowell & Moring LLP

(57) ABSTRACT

A high-frequency MEMS switch comprises a signal conductor which is arranged on a substrate and an oblong switching element which has a bent elastic bending area and is fastened on the substrate in a cantilevered manner. An electrode arrangement generates an electrostatic force which bends the switching element toward the signal conductor. The switching element is arranged longitudinally parallel to the signal conductor, and has a contact area which extends transversely to the switch element over the signal conductor. Under the effect of the electrostatic force, the elastic bending area of the switching element progressively approaches the electrode arrangement in a direction parallel to the signal line. The switching element has, for example, two mutually parallel extending switching arms, which are mutually connected by a bridge as the contact area and are arranged on both sides of the signal line and parallel thereto.

15 Claims, 2 Drawing Sheets

U.S. PATENT DOCUMENTS

| | | | | |
|---|---|---|---|---|
| 6,657,525 | B1 * | 12/2003 | Dickens et al. | 335/78 |
| 7,196,599 | B2 * | 3/2007 | Dabbaj | 335/78 |
| 7,453,339 | B2 * | 11/2008 | Fork et al. | 335/78 |

FOREIGN PATENT DOCUMENTS

| | | | |
|---|---|---|---|
| EP | 1 246 216 | A2 | 10/2002 |
| JP | 2002 100276 | A | 4/2002 |
| WO | WO 02/073673 | A1 | 9/2002 |

OTHER PUBLICATIONS

Gabriel M. Rebeiz et al., "RF MEMS Switches, Switch Circuits, and Phase Shifters", Revue HF No. Feb. 2001, (Thirteen (13) pages).

Chienliu Chang et al., "Innovative Micromachined Microwave Switch With Very Low Insertion Loss", Jun. 7-10, 1999, Sendai, Japan, (pp. 1830-1833).

* cited by examiner

HIGH FREQUENCY MEMS SWITCH HAVING A BENT SWITCHING ELEMENT AND METHOD FOR ITS PRODUCTION

BACKGROUND AND SUMMARY OF THE INVENTION

This application claims the priority of German patent document 10 2004 010 150.7, filed Feb. 27, 2004 (PCT International Application No. PCT/DE2005/000317, filed Feb. 25, 2005), the disclosure of which is expressly incorporated by reference herein.

The present invention relates to a high-frequency MEMS switch having a bent switching element.

MEMS switches or switching elements in the MEMS technology (MEMS=Micro Electro Mechanical Systems) are used in many different fields, such as automobile electronics, telecommunications, medical engineering or measuring technology. As a result of their miniaturization, such switching elements further developed as a micro electro mechanical system are particularly suitable also for space flight applications and satellite systems. High-frequency MEMS switches are also particularly suited for use in radar systems, satellite communications systems, wireless communication systems and instrument systems. High-frequency MEMS switches are, for example, also required in phase antenna facilities and in the case of phase shifters for satellite-based radar systems.

High-frequency MEMS switches offer a number of advantages, such as an extremely low power consumption, good insulation or low interference capacities, low insertion loss or low insertion attenuations and low manufacturing costs.

The article "*RF MEMS Switches, Switch Circuits and Phase Shifters*" by Gabriel M. Rebeiz et al. in Revue HF No. 2/2001, describes MEMS switches which are used in the high-frequency range, in a range of between 0.1 and 100 GHz. These MEMS switches have cantilever switching arms in the form of mechanical springs which are operated by the effect of electrostatic force for the opening or closing of an electric circuit. The cantilever switching arm or cantilever bar is fastened on a substrate and is electrostatically attracted by an electrode in order to close a contact. Without an applied voltage, the switching arm returns into its starting position as a result of elastic restoring forces, and the contact is opened.

In the case of MEMS switches, the switching operation can be caused in different manners which are basically illustrated as examples in FIGS. 3*a-f*. In this case, a switching element influences the traveling of an electromagnetic wave on a signal line by opening or closing a transmission path. This can take place in the manner of a series-parallel switch, of a shunt switch or of a series-shunt switch. In the opened condition of the switching element, a large distance to the contact area is generally necessary because, in this condition, the capacitance should be as low as possible in order to obtain an interference-free line. However, a short distance is required for the switching operation itself since only low electrostatic forces are active.

The article by C. Chang and P. Chang "*Innovative Micromachined Microwave Switch with Very Low Insertion Loss*", Proceedings of the 10th International Conference on Solid-State Sensor Actuators (Transducers 99), Jun. 7-10, 1999, Sendai, Japan, Page 1830-33, describes a MEMS switch with a bent switching element in the shape of a cantilever bar as a cantilever element. The switching element is fastened above a ground electrode with one end on a substrate, the remaining area of the switching element being oriented upward in a curved manner and projecting away from the substrate. When a switching voltage is applied, the upward-bent switching element is applied to the ground electrode by electrostatic forces, so that the free end of the switching element comes in contact with a signal line. Without the applied switching voltage, the switching element is moved back by an elastic tensile stress into the upward-oriented position in which it is far away from the signal line. During the back-and-forth switching between the two switching conditions, the switching element moves like a frog's tongue.

MEMS switches generally have the problem that the elastic restoring forces as a rule are very low, so that there is the danger that the switching element clings to the surface of the signal line as a result of adhesion. The switching elements therefore often lack sufficient reliability which is necessary for long-term missions, for example, in space.

It was therefore attempted to provide the switching element with a stronger design in order to achieve stronger restoring forces. However, the electrostatic forces are not sufficient in most cases for reliably causing the switching operations.

It is therefore an object of the present invention to provide a high-frequency MEMS switch having a bent switching element, which ensures a high long-term reliability while the interference capacities are low.

Another object of the invention is to provide such a switch in which a higher mechanical stability.

Finally, still another object is to provide a switch which achieves a greater switching force are achieved while the space requirement is low.

These and other objects and advantages are achieved by the high-frequency MEMS switch according to the present invention, which comprises a signal conductor arranged on a substrate. An oblong-shaped switching element has a bent elastic bending area and is fastened on the substrate in a cantilevered manner. An electrode arrangement generates an electrostatic force that acts upon the switching element, in order to bend it toward the signal conductor. The switching element in its longitudinal direction is arranged parallel to the signal conductor and has a contact area extending transversely to the switching element partially or completely over the signal conductor. Under the effect of electrostatic force, the elastic bending area of the switching element approaches the electrode arrangement parallel to the signal line in a progressive manner.

In the high-frequency MEMS switch according to the invention, the voltage required for closing the element is kept low, while a large switching path is permitted, so that the distance to the open condition is large and the capacitance is therefore low. By arranging the switching element in its longitudinal direction parallel to the signal conductor, a further miniaturization is also achieved, in which case the switching element can nevertheless have a relatively long design, and a higher mechanical stability and a greater switching force can therefore be achieved. In particular, a greater restoring force or a stronger switching element also become possible. As a result of the large possible length and surface of the switching element, greater electrostatic forces, on the one hand, and greater restoring forces or a thicker switching element, on the other hand, can be achieved.

The switching element preferably comprises at least two switching arms with a bent elastic bending area, which are arranged on both sides of the signal conductor and extend in their longitudinal direction parallel to the signal conductor. The switching arms are connected with one another by a bridge positioned over the signal conductor, which bridge is formed by the respective contact area. The reliability of the MEMS switch is even further increased because still higher restoring forces and electrostatic forces can be achieved while the space and energy demand is low. As a result, a particularly high mechanical stability and switching force are achieved while the space and energy requirements are low.

The electrode arrangement is advantageously formed by at least one ground or base electrode which is arranged below the switching element in a flat manner on the substrate in order to electrostatically attract the switching element. If the switching arms are arranged on both sides, the base electrode or ground electrode is arranged below each switching arm.

According to another preferred embodiment, the electrode arrangement is formed by a ground electrode arranged below the substrate or by the substrate itself. This results in a simplified production and therefore in reduced production costs. The substrate may be manufactured from high-ohmic silicon.

The electrode arrangement advantageously extends parallel to the substrate surface so that the electrostatic force pulls the switching element in its bending area progressively to the substrate surface. The bent bending area is preferably formed by bimorphic material.

Another advantageous further embodiment provides that, for generating a tensile stress, the bending area has a surface melted-on, for example, by laser heating. This has the advantage that the tensile stress can be adjusted by the corresponding selection of the duration and intensity of the laser irradiation corresponding to the respective demands. The tensile stress can also be achieved by the appropriate control of the layer deposition during production.

The switching element is advantageously produced by means of the thin-film technology. As a result, a cost-effective production and a small construction are achieved.

The contact area of the switching element preferably comes in direct contact with the signal conductor under the effect of the electrostatic force. As an alternative, under the effect of the electrostatic force, the contact area takes up a minimal distance from the signal conductor; that is, it does not come in direct contact with the signal conductor. This results in a high capacitance between the signal conductor and the switching element, so that the signal line is interrupted. The minimal distance can be achieved or maintained, for example, by a suitable dielectric insulation.

A method of producing a high-frequency MEMS switch having a belt switching element according to the invention includes the following steps: constructing a signal line on a substrate; as required, forming an electrode arrangement on the substrate (for example, if the substrate has no intrinsic conduction); forming an oblong switching element having a bent elastic bending area on the substrate such that, in its bending area, it is pulled by the electrode arrangement by an electrostatic force lengthwise toward the substrate and, by an elastic restoring force, in the bending area, moves away from the substrate. The switching element in its longitudinal direction parallel to the signal conductor is arranged such that a laterally projecting contact area of a the switching element extends transversely-over the signal conductor, so that the elastic bending area of the switching element, under the effect of the electrostatic force parallel to the signal line, progressively approaches the electrode arrangement in order to bring the contact area in the proximity of the signal conductor. The electrode arrangement may also be formed by an intrinsically conducting substrate or an intrinsically conducting substrate area.

By means of the method, a particularly reliable high-frequency MEMS switch having a bent switching element is produced in a cost-effective manner, which has an increased mechanical stability and higher switching forces.

Advantageously, the switching element is shaped such that it has at least two switching arms having a bent elastic bending area. The switching arms are arranged on both sides of the signal conductor, so that they extend in their longitudinal direction parallel to the signal conductor, and the switching arms are connected with one another by a bridge positioned over the signal conductor, which bridge is formed by the respective contact area.

Preferably, at least one base electrode as the electrode arrangement under the switching element is arranged flatly on the substrate. At least one ground electrode arranged below the substrate can also be formed as the electrode arrangement. Advantageously, the bending area is formed by bimorphic material. However, it is particularly advantageous for the surface of the bending area to be melted on by means of laser heating for generating a tensile stress. In particular, the method can be used for producing the high-frequency MEMS switch further developed according to the invention, as it is generally described above.

Other objects, advantages and novel features of the present invention will become apparent from the following detailed description of the invention when considered in conjunction with the accompanying drawings.

DETAILED DESCRIPTION OF THE DRAWINGS

Figure 1:
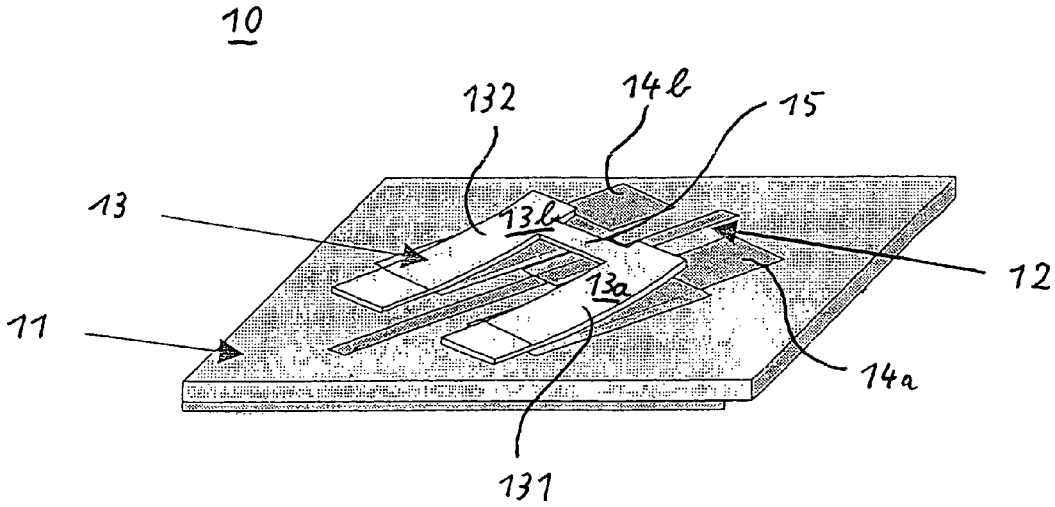
FIG. 1 is a schematic perspective view of a high-frequency MEMS switch according to a particularly preferred embodiment of the invention.

FIG. 1 illustrates a particularly preferred embodiment of a MEMS switch 10 according to the invention, which is suitable for high-frequency applications and has two parallel switching arms. The MEMS switch 10 comprises a substrate 11 on which a signal line 12 is constructed which extends in one direction over the substrate 11. An upward-bent switching element 13 is fastened on the substrate, which switching element 13 in this example comprises two longitudinally arranged switching arms 13*a*, 13*b* that extend parallel to one another. The switching arms 13*a*, 13*b* of the switching element 13 are each fastened with one end flatly on the substrate surface and parallel thereto, while their remaining part is bent upward, so that the other ends of the switching arms 13*a*, 13*b* are away from the substrate surface. For this purpose, each switching arm 13*a*, 13*b* of the switching element 13 has a central elastic area 131, 132 which is bent or curved upward in the switch position illustrated here.

On the substrate surface, an electrode arrangement is provided below each switching arm 13*a*, 13*b* of the switching element 13, which electrode arrangement is formed in this area by two ground electrodes 14*a*, 14*b*. The ground electrodes 14*a*, 14*b* have the purpose of exerting an electrostatic attraction force on the switching arms 13*a*, 13*b* fastened in a cantilevered manner, when a switching voltage is present. As a result, the switching arms move toward the substrate surface, so that the elastic bending areas 131, 132 assume a straight shape.

Furthermore, the switching element 13 comprises a contact area 15 which, in this example, extends transversely over the signal line 12. When an electrostatic force is exerted on the bending areas 131, 132 (and on the free ends of the switching arms 13*a*, 13*b*) by means of the electrode arrangement 14*a*, 14*b*, the contact area 15 approaches the signal line 12 in order to cause a direct electric contact or a capacitive coupling to the signal line 15. In this case, the MEMS switch 10 is in its closed condition.

In its bending areas 131, 132, the switching element 13 is provided with a tensile stress which causes a restoring force so that the switching arms 13*a*, 13*b* return into the bent condition when no electrostatic attraction force is exerted upon the switching arms 13*a*, 13*b* by the ground electrodes 14*a*, 14*b*. In this case, the MEMS switch 10 takes up its open condition, in which the contact area 15 is away from the signal line 12. Therefore, no electric contact exists and no (or only a very low) capacitive coupling exists to the signal line 12.

With its cantilever switching arms 13*a*, 13*b* provided in the form of oblong bars, the switching element 13 is arranged in its longitudinal direction parallel to the signal line 12. In this case, the contact area 15 forms a bridge which mutually connects the two switching arms 13*a*, 13*b* in the area of their free ends and, in this embodiment, extends completely over the signal line 12 transversely to the latter. When electrostatic force acts upon the switching arms 13*a*, 13*b* by means of the ground electrodes 14*a*, 14*b*, the switching arms 13*a*, 13*b*, in steps or continuously, from their fastened ends, approach the ground electrodes in a direction extending parallel to the signal line 12.

Figure 2:
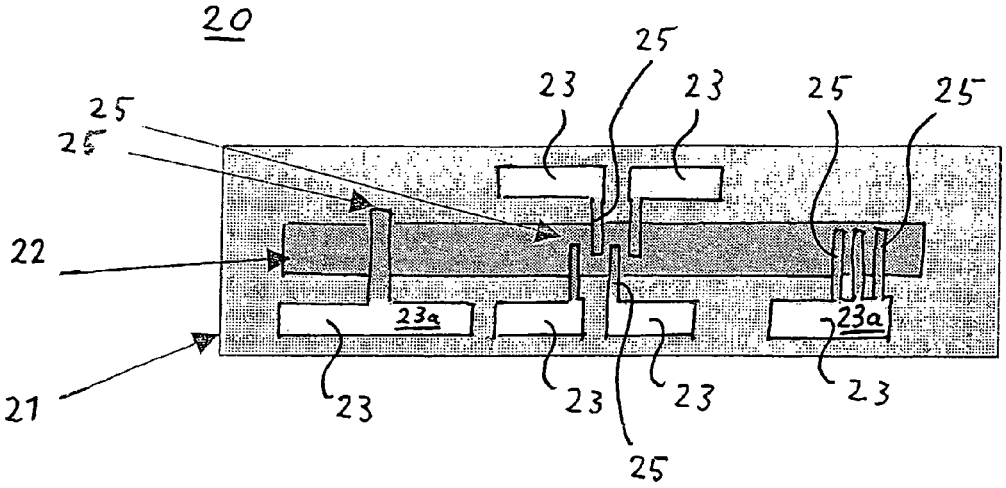
FIG. 2 is a schematic top view of an arrangement of MEMS switches according to further preferred embodiments.

FIG. 2 is a top view of an arrangement of MEMS switches 20, in which the individual switching elements 23 each only have one oblong cantilever switching arm 23*a*, which extends parallel to the signal line 22. Each of the switching elements 23 has one or more contact areas 25 laterally arranged on the respective switching arm 23*a*, which contact area 25 extends transversely over the signal line 22. In this case, the respective contact area 25 may extend transversely, either completely over the entire width of the signal line 22 or only partially. Several contact areas 25 may also be arranged laterally on a switching element 23, as illustrated on the right-hand side in FIG. 2.

The switching elements 25, which in FIG. 2 are arranged in the center area on both sides of the signal line 22, are aligned such that their opposite contact areas 25 engage in one another in a tooth-type manner above the signal line 22.

The high-frequency MEMS switch 10 illustrated in FIG. 1 is constructed in a shunt configuration. In the upward-oriented position of the switching arms 13*a*, 13*b* arranged as cantilever elements or in a cantilevered manner, the coupling capacitance is very low because of the distance between the signal line 12 and the contact area 15. The influence on the traveling of an electromagnetic wave on the signal line 12 is therefore also low. When an excitation voltage or switching voltage is applied to the structure, the curved switching element 13 is caused to bend downward, so that the bridge-type contact area 25 reaches the signal line 12 or its direct proximity, so that a high capacitance is created between the signal line 12 and the switching element 13, whereby the traveling of the electromagnetic wave on the transmission or signal line 12 is prevented or interrupted.

The illustrated switching elements 13, 23 with their switching arms 13*a*, 13*b*, 23*a* and contact areas 15, 25 are produced by thin-film technology. The bent switching elements have their switching arms arranged parallel to the signal line 12, 25 and, in the embodiment illustrated in FIG. 1, connected by a bridge which is formed by contact area 15. The signal line 12, 22, which extends below the bridge or the contact area 15, 25 on the substrate 11, 21, typically has an electric resistance of, for example, approximately 50Ω. However, it may also be further developed with other resistances, depending on the requirements of the particular application. The MEMS switch forms an HF relay.

Figure 3:
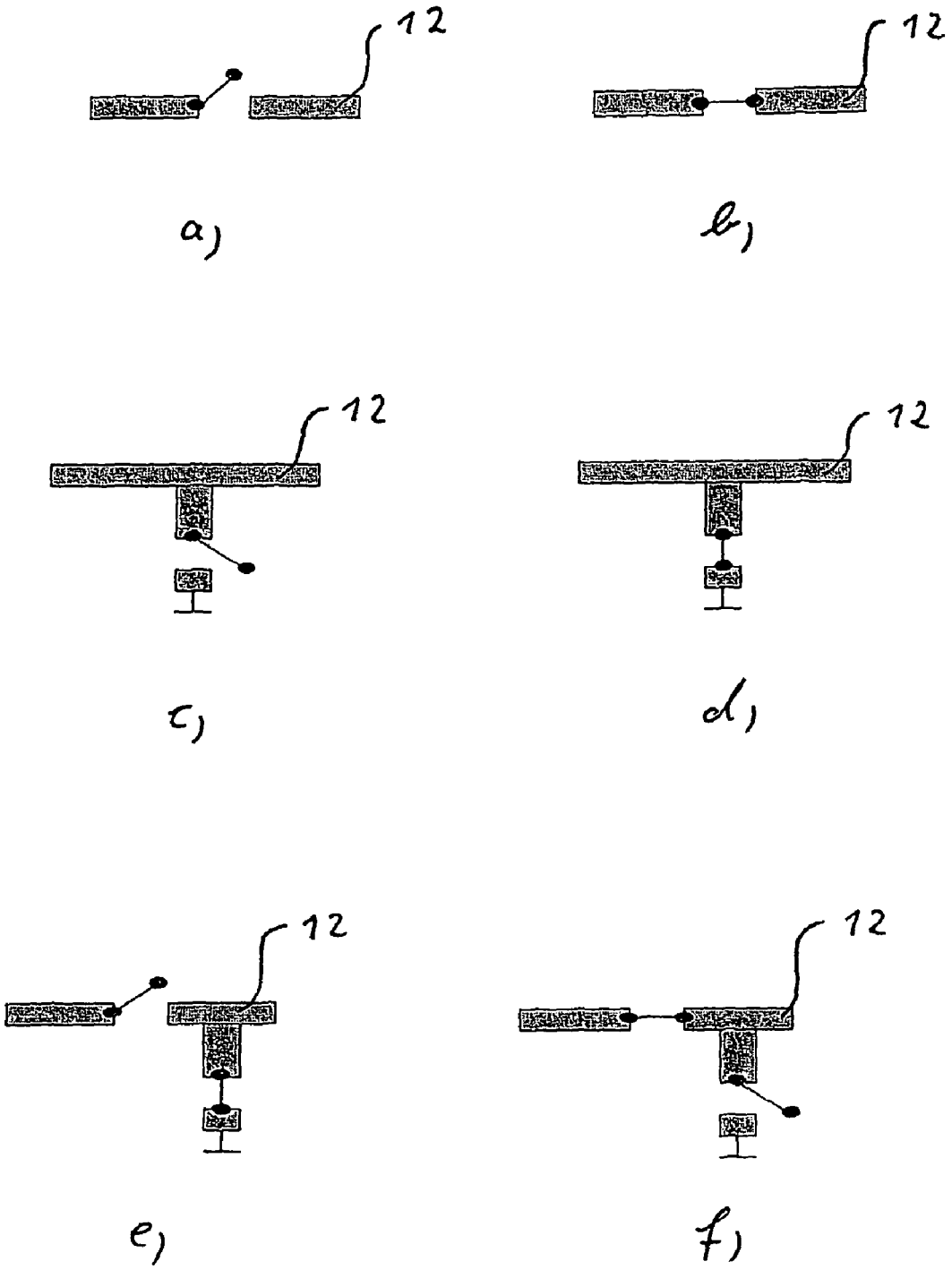
FIGS. 3*a-f* are schematic views of different switch configurations of MEMS switches.

FIGS. 3*a-f* show various switch configurations as examples, which can be implemented by means of the MEMS switch according to the invention. FIGS. 3*a* and 3*b* show a switching in series with the signal line 12, the signal line being interrupted in FIG. 3*a*, and the signal line 12 being closed in FIG. 3*b*.

FIGS. 3*c* and *d* show shunt-switch configurations in which the switching takes place by an electric shunt. In this case, the signal line 12 is closed in FIG. 3*c* because the switch is open and therefore no shunt is present. In FIG. 3*d*, the signal line 12 is interrupted because the switch is closed and the shunt is present.

FIGS. 3*e* and *f* show a combination of a series and shunt configuration, the switch in the signal line 12 being open in FIG. 3*e*, and the shunt being closed in FIG. 3*f*.

The substrate 11, 21 is made of a semiconductor material, while the signal line 12, 22 and the switching element 13, 23 are produced from a highly conductive material, such as Al, Cu, Au, etc.

When producing the MEMS switch, first electrically conductive layers are constructed as the signal line and the electrode arrangement on the substrate. Subsequently, the switching element 13, 23 is fastened in a cantilevered manner on the substrate surface. For generating the bending and the restoring force in the bending area of the switching element, its surface is melted on by means of laser heating in order to create the required tensile stress in the elastic bending area. However, bimorphic material may also be used for causing the curvature and the restoring force into the bent condition. Instead of a ground electrode, a high-ohmic substrate can also be used for generating an electrostatic attraction force. On its backside, this high-ohmic substrate is provided with a metallization 17 which is used as the ground. This possibility is also schematically illustrated in FIG. 1.

During the production, the so-called sacrificial layer used in known processes can be replaced by a suitable surface modification, for example, by water-proofing. As a result, the distance between the switching element and the ground electrode or the substrate surface becomes even shorter, so that considerably larger electric fields and correspondingly lower operating voltages are achieved.

As a result of the bent shape of the switching element in its longitudinal direction parallel to the direction of the signal line, a particularly long switching path becomes possible, so that the distance in the open condition in the case of a small size of the switching element, can nevertheless be designed to be large, and the capacitance in the open condition is therefore low.

By means of the arrangement according to the invention, a higher mechanical stability is reached. Furthermore, the switching elements can be provided with a greater restoring force because, as a result of the geometrical arrangement of the electrodes and of the switching elements, a greater electrostatic attraction force can be achieved; thus in the opened condition, low interference capacity is nevertheless present. Particularly in largely autonomous systems and mainly in the case of satellite applications, an improved long-term stability and a greater reliability are achieved by means of the further development of the high-frequency MEMS switch according to the invention. In this case, the risk of adhesion or generally a clinging or catching of the switching element on the substrate surface or the surface of the signal line is reduced or eliminated.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. MEMS switch having a bent switching element, comprising:

a signal conductor arranged on a substrate;

an oblong-shaped switching element, which has a bent elastic bending area and is fastened in a cantilevered manner on the substrate; and an electrode arrangement for generating an electrostatic force that acts upon the switching element and bends it toward the signal conductor; wherein, the switching element includes at least two switching arms having a bent elastic bending area;

the switching arms are arranged on both sides of the signal conductor parallel thereto;

free ends of the switching arms are mutually connected by a bridge that is positioned over the signal conductor;

the switching arms are configured such that under the effect of the electrostatic force, the respective elastic bending areas progressively approach the electrode arrangement in a direction parallel to the signal conductor.

2. The high-frequency MEMS switch according to claim 1, wherein the bridge forms a contact area.

3. The high-frequency MEMS switch according to claim 1, wherein the electrode arrangement comprises at least one ground electrode arranged under the switching element flatly on the substrate to electrostatically attract the switching element.

4. The high-frequency MEMS switch according to claim 1, wherein the electrode arrangement comprises one of a ground electrode arranged below the substrate, and the substrate itself.

5. The high-frequency MEMS switch according to claim 1, wherein the electrode arrangement extends parallel to the substrate surface in order to pull the switching element by the electrostatic force in its bending area progressively toward the substrate surface.

6. The high-frequency MEMS switch according to claim 1, wherein the bent bending area is formed of bimorphic material.

7. The high-frequency MEMS switch according to claim 1, wherein the bending area has a surface melted-on by laser heating for generating a tensile stress.

8. The high-frequency MEMS switch according to claim 1, wherein the switching element is produced by thin-film technology.

9. The high-frequency MEMS switch according to claim 1, wherein under the effect of the electrostatic force, the contact area comes in direct contact with the signal conductor.

10. The high-frequency MEMS switch according to claim 1, wherein under the effect of the electrostatic force, the contact area takes up a minimal distance from the signal conductor.

11. A method of producing a high-frequency MEMS switch having a bent switching element, said method comprising:

constructing a signal conductor on a substrate;

constructing an electrode arrangement on the substrate;

forming an oblong switching element having a bent elastic bending area on the substrate such that, in the bending area, it is pulled by the electrode arrangement by an electrostatic force lengthwise toward the substrate and, by an elastic restoring force, in the bending area, moves away from the substrate; wherein, the switching element has at least two switching arms, each having a bent elastic bending area, which are arranged on both sides of the signal conductor parallel thereto, and are mutually connected at a free end by a bridge positioned over the signal conductor;

the switching arms are configured such that, under the effect of the electrostatic force, the respective elastic bending areas progressively approach the electrode arrangement in a direction parallel to the signal conductor.

12. The method according to claim 11, wherein the bridge forms a contact area.

13. The method according to claim 11, wherein at least one ground electrode arranged below the substrate forms the electrode arrangement.

14. The method according to claim 11, wherein the surface of the bending area is melted on by laser heating for generating a tensile stress.

15. The method according to claim 11, wherein the electrode arrangement is formed by at least one intrinsically conducting substrate area or by one intrinsically conducting substrate.

* * * * *